United States Patent [19]

Mori

[11] Patent Number: 4,674,458

[45] Date of Patent: Jun. 23, 1987

[54] SYSTEM AND METHOD FOR SUPPLYING FUEL TO A VEHICULAR INTERNAL COMBUSTION ENGINE

[75] Inventor: Yasushi Mori, Yokohama, Japan

[73] Assignee: Nissan Motor Company, Limited, Japan

[21] Appl. No.: 719,018

[22] Filed: Apr. 2, 1985

[30] Foreign Application Priority Data

Apr. 4, 1984 [JP] Japan ..... 59-65954

[51] Int. Cl.[4] ..... F02D 41/12

[52] U.S. Cl. ..... 123/333; 123/493; 74/872

[58] Field of Search ..... 123/325, 332, 333, 493, 123/198 DB; 74/857, 859, 860, 872

[56] References Cited

U.S. PATENT DOCUMENTS 4,395,984 8/1983 Yamaguchi et al. ..... 123/325
4,416,230 11/1983 Katayose et al. ..... 123/325
4,434,759 3/1984 Iezuka et al. ..... 123/325
4,532,901 8/1985 Sturdy ..... 123/333

*Primary Examiner*—William A. Cuchlinski, Jr.
*Attorney, Agent, or Firm*—Leydig, Voit & Mayer

[57] ABSTRACT

Disclosed is a system for supplying fuel to a vehicular internal combustion engine and method therefor, wherein the speed of the vehicle is detected from an instantaneous revolution speed of an output axle of a transmission of the vehicle, a gear shift position of the transmission is detected, a first engine speed at which the supply of fuel to the engine is to be cut off is determined on the basis of the detected instantaneous revolution speed of the output axle of the transmission and the gear shift position of the transmission, the first engine speed is compared to a preset second engine speed at which the supply of fuel is to be resumed following the cut-off of the supply of fuel to the engine, and the supply of fuel is cut off only when the first engine speed exceeds the preset second engine speed.

5 Claims, 6 Drawing Figures

FIG.4(III)
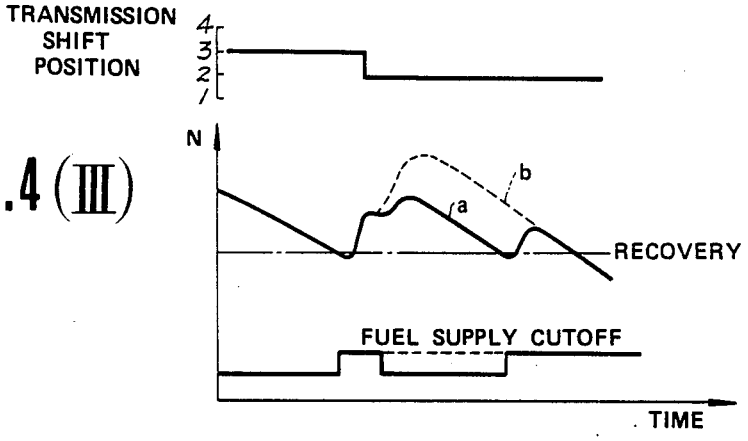

SYSTEM AND METHOD FOR SUPPLYING FUEL TO A VEHICULAR INTERNAL COMBUSTION ENGINE

BACKGROUND OF THE INVENTION

1. Field of the Invention

The present invention relates to a system and method for supplying fuel to an internal combustion engine of a vehicle which cuts off the supply of fuel when a predetermined engine operating condition is satisfied.

2. Description of the Prior Art

Conventionally, the system for supplying fuel to the internal combustion engine for a vehicle cuts off supply of fuel when the output power of the engine is not needed, such as during deceleration, in order to conserve fuel.

Conventional systems as described above are exemplified by U.S. Pat. No. 4,395,984 filed on Sept. 25, 1980. There is, however, a problem in this conventional system in that since the conventional system generally starts to cut off fuel supply during deceleration solely on the condition that the engine revolution speed is above a predetermined value, if the vehicular transmission should be in an excessively low gear at the moment of cut-off, the engine revolution speed will drop abruptly so that the total fuel savings will be insignificant while harmful exhaust components due to incomplete combustion may be emitted and passengers will still be subjected to an uncomfortable jolting sensation. These adverse effects are especially likely in cases where the vehicle has a power transmission, e.g., including a torque converter.

There is another problem in that since the conventional system resumes the currently cut-off fuel supply when the engine revolution speed rises above a predetermined limit, e.g. due to a long run of downhill or down-shifting of an automatic transmission to a lower gear position, and at the same time sets the fuel cut-off threshold speed higher than the engine revolution speed at which the fuel supply was first cut off, the total amount of fuel conserved may be less than is safely possible even though the fuel supply is cut off a second time.

SUMMARY OF THE INVENTION

With the above-mentioned problems in mind, it is an object of the present invention to provide a system for supplying fuel to a vehicular internal combustion engine and method therefor which achieves an appropriate cutoff of fuel supply to the engine.

The above object can be achieved by the system comprising: (a) first means for detecting a speed of the vehicle from an instantaneous revolution speed of an output axle of a transmission of the vehicle; (b) second means for detecting a gear shift position of the transmission; (c) third means for determining a first engine speed at which the supply of fuel to the engine is to be cut off on the basis of the instantaneous revolution speed of the output axle of the transmission detected by the first means and the gear shift position of the transmission; (d) fourth means for comparing the first engine speed to a preset second engine speed at which the supply of fuel is to be resumed following the cut-off of the supply of fuel to the engine; and (e) fifth means for cutting off the supply of fuel only when the first engine speed exceeds the preset second engine speed.

The above object can also be achieved by a system comprising: (a) first means for determining whether a throttle valve of the engine is fully closed; (b) second means for calculating an engine speed at which the fuel supply to the engine is to be cut off on the basis of a transmission torque to the engine when said first means determines that the throttle valve is fully closed; (c) third means for setting an engine speed at which the fuel supply to the engine is to be resumed with deviations in the engine characteristics imparted during engine manufacture in mind; and (d) fourth means for cutting off the fuel supply when the calculated engine speed exceeds the set engine speed.

The above object can further be achieved by a method comprising the steps of: (a) determining whether a throttle valve of the engine is fully closed; (b) detecting an instantaneous revolution speed of an output axle of an automatic transmission when the throttle valve is fully closed; (c) detecting a gear shift position of the automatic transmission; (d) calculating the revolution speed of an input axle of an automatic transmission of the basis of the output axle of the automatic transmission and the gear shift position when the throttle is fully closed; (e) deriving an engine speed at which the fuel supply to the engine is to be cut off from the revolution speed of the input axle of the automatic transmission calculated in step (d); (f) comparing the engine speed derived in the step (e) to a preset engine speed at which the fuel supply is to be resumed following cut-off; and (g) cutting off the fuel supply only when the derived engine speed exceeds the preset engine speed in the step (f).

BRIEF DESCRIPTION OF THE DRAWINGS

A more complete understanding of the present invention may be obtained from the foregoing description taken in conjunction with the drawings in which.

DETAILED DESCRIPTION OF THE PREFERRED EMBODIMENT

Reference will hereinafter be made to the drawings in order to facilitate understanding of the present invention.

Figure 1:
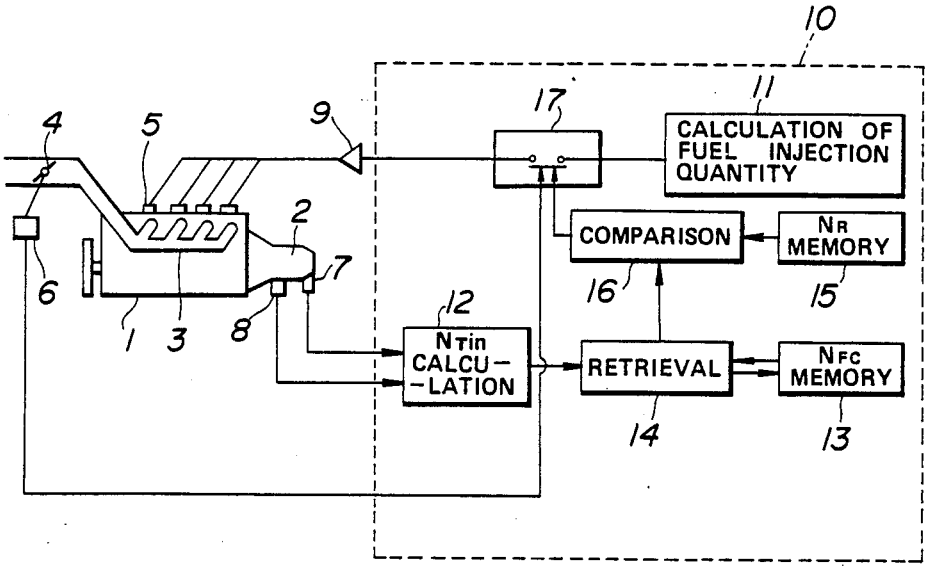
FIG. 1 is a functional block diagram of the system for supplying fuel to the engine according to the present invention.

FIG. 1 shows a preferred embodiment of the present invention.

In this embodiment, the system according to the present invention is applicable to an automatic transmission, a torque converter of which is linked to the crankshaft of the engine. In this embodiment, the engine revolution speed at the value used to determine when the fuel supply is to be cut off is derived from the calculated revolution speed of an input axle of the transmission representing the torque on the crankshaft when the fuel supply to the engine is to be cut off.

In FIG. 1, a controlled amount of intake air is supplied via an intake passage 3 to each engine cylinder 1 and a controlled amount of fuel in accordance with the intake air quantity is also supplied via a fuel injection valve 5 is the conventional manner. The amount of intake air is controlled by means of a throttle valve 4 in the conventional manner. Numeral 2 shown in FIG. 1 denotes an automatic transmission. An idle switch 6 is associated with the throttle valve 4 for detecting and signalling that the throttle valve 4 is fully closed. A vehicle speed sensor 7 is installed in the automatic transmission 2 for detecting the vehicle speed from the revolution speed of an output axle of the automatic transmission 2. In addition, a shift position sensor 8 is provided for detecting the gear position of the automatic transmission 2.

In FIG. 1, numeral 10 denotes a control unit. The control unit 10 calculates the amount of fuel to be injected through the fuel injection valve 5 in accordance with the intake air quantity at 11, produces an electrical signal indicative of the calculated amount of fuel, and energizes the fuel injection valve 5 via an amplifier 9. Other functions of the control unit 10 include calculating (12) the revolution speed $N_{Tin}$ of the input axle of the transmission 2 from output signals derived from the vehicle speed sensor 7 and shift position sensor 8, storing (13) the engine speed $N_{FC}$ at which the fuel supply is to be cut off corresponding to the above-described revolution speed $N_{Tin}$, retrieving (14) the engine speed $N_{FC}$ on the basis of the calculated revolution speed $N_{Tin}$ of the input axle of the transmission, storing (15) the engine speed $N_R$ (recovery engine speed) at which fuel supply is to resume, comparing (16) the engine speed $N_{FC}$ at which the supply of fuel is to be cut off with the recovery revolution speed $N_R$ and interrupting (17) output of the value derived at 11 in accordance with the results of comparison at 16 and the signal from the idle switch 6.

The operation of the system for supplying fuel to the engine shown in FIG. 1 will be described below.

It is noted that the conventional fuel cutoff operation and parameters for determining engine operating conditions are exemplified by U.S. Pat. No. 4,395,984, the disclosure of which is hereby incorporated by reference.

Figure 2:
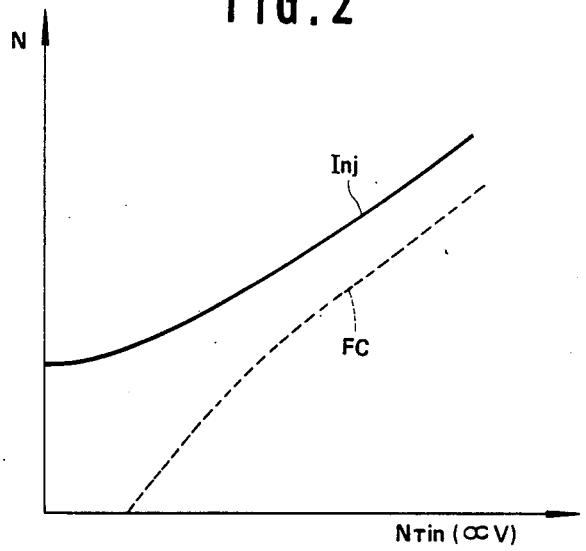
FIG. 2 is a characteristic graph of the relationship between engine speed and revolution speed of an input axle of an automatic transmission.

FIG. 2 shows the relationship between the engine speed N and the number of revolutions $N_{Tin}$ of the input axle of the automatic transmission 2 linked to the crankshaft of the engine via the torque converter. In FIG. 2, the solid curve $I_{nj}$ denotes the idling state of the engine and the broken curve FC denotes the limit for cutoff of fuel supply. It should be noted that the revolution speed $N_{Tin}$ of the input axle of the automatic transmission 2 is substantially proportional to the vehicle speed V of the vehicle on which the above-described transmission 2 is mounted provided that the gear position thereof is unchanged.

Thus, the relationship between the engine speed N and the revolution speed $N_{Tin}$ of the input axle of the transmission can be obtained for the combination of an engine and a torque converter. The above relationship is closely related to the torque applied by the transmission 2 on the engine 1. In other words, the revolution speed $N_{Tin}$ of the input axle of the transmission 2 represents indirectly the transmission torque to the engine.

Hence, if the relationship shown in FIG. 2 is previously obtained by experiment and stored and the engine speed corresponding to the calculated revolution speed of the input axle $N_{tin}$ is read out, the engine speed $N_{FC}$ at which the fuel supply is to be cut off can be accurately estimated.

Figure 3:
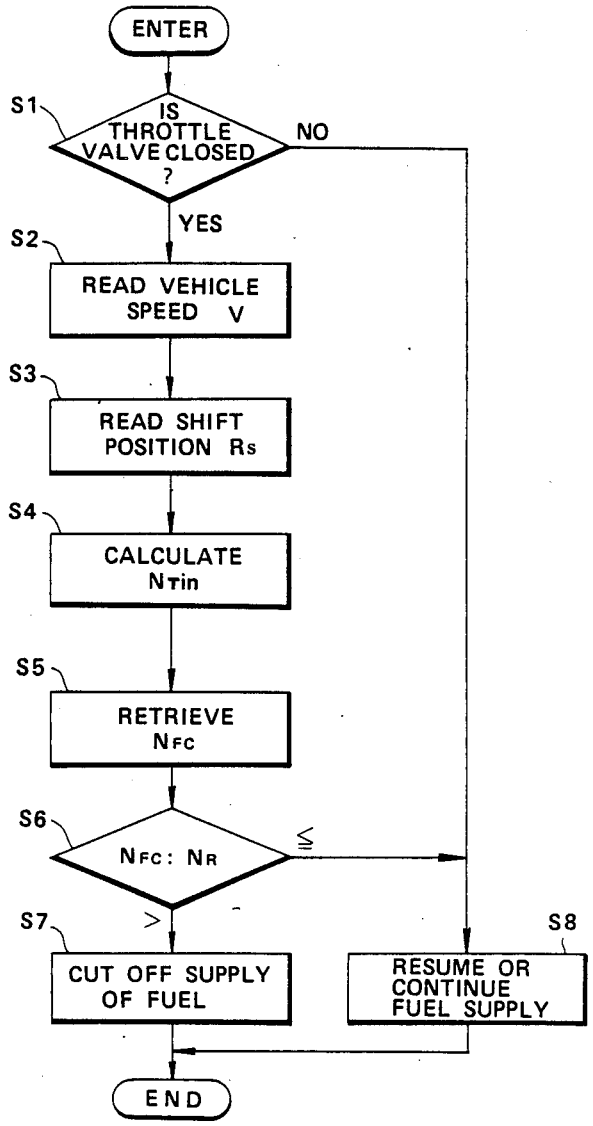
FIG. 3 is an operational flowchart of a microcomputer shown in FIG. 1.

FIG. 3 is an operational flowchart for the control unit 10. It is noted that the control unit 10 comprises a microcomputer including in terms of hardware a Central Processing Unit (CPU), Random-Access Memory (RAM), Read-Only Memory (ROM), and Input/Output Port (I/O Port).

In a step S1, the microcomputer 10 determines whether or not the throttle valve 4 is fully closed as indicated by the idle switch 6. If the throttle valve 4 is not fully closed, the routine goes to a step S8 wherein the microcomputer 10 continues or resumes the supply of fuel.

If the microcomputer 10 recognizes that the throttle valve 4 is fully closed from the idle switch 6 in the step S1, the routine goes to a step S2 wherein the vehicle speed V is detected on the basis of the signal derived from the vehicle speed sensor 7. In a step S3, the microcomputer 10 reads the gear position of the transmission 2 from the output signal from the shift position sensor 8. Since the transmission gear ratio $R_s$ is known for each gear position S, the revolution speed $N_{Tin}$ of the input axle of the transmission 2 can be calculated in the next step S4 from the following formula:

$$N_{Tin}=R_s \cdot k \cdot V,$$

wherein k denotes a predetermined coefficient for converting the vehicle speed V into the revolution speed of the input axle of the transmission and $R_s$ denotes the predetermined gear ratio.

In a step S5, the microcomputer 10 retrieves the engine speed $N_{FC}$ at which the supply of fuel is to be cut off which corresponds to the engine speed $N_{Tin}$ of the input axle of the transmission as shown in FIG. 2. In a step S6, the microcomputer 10 compares a predetermined recovery speed $N_R$ with the retrieved engine speed $N_{FC}$. If $N_{FC}>N_R$ in the step S6, the microcomputer 10 cuts off the fuel supply in the step S7. If $N_{FC} \geqq N_R$ in the step S6, the routine goes to the step S8 and continues or resumes the fuel supply since the fuel supply needs to be resumed immediately even if it had ust been cut off to prevent engine stalling.

Figure 4I:
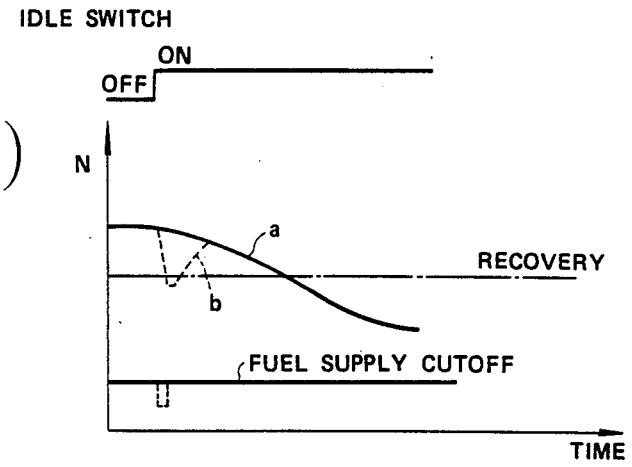
FIGS. 4(I), (II) and (III) are graphs of control characteristics under various engine operating conditions.
Figure 4:
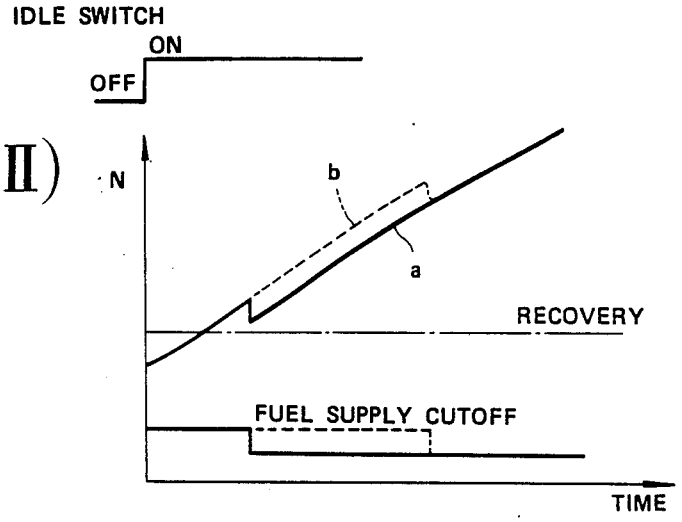

FIGS. 4(I), 4(II), and 4(III) illustrate the behavior of engine speed with respect to time when the present invention is applied to a vehicle such as that shown in FIG. 1, comparing the conventional fuel supply system.

In FIGS. 4(I), 4(II), and 4(III), the solid curve a denotes the case when the present invention is employed and the broken curve b denotes the case when the conventional system for supplying fuel to the engine is employed.

FIG. 4(I) illustrates the abrupt drop in engine speed in conventional systems when the transmission is in a relatively low gear and at an engine speed only slightly above the cut-off level, so that the duration of fuel supply cutoff is extremely short. Such a brief cutoff of fuel supply as shown at a bottom position of FIG. 4(I) is inhibited by the present invention, as illustrated by curve a because the enhanced engine braking due to the low gear position is accounted for in determining the input shaft speed $N_{Tin}$.

FIG. 4(II) shows the variation of engine speed with respect to time as the vehicle rolls downhill with the throttle valve 4 fully closed. As shown in FIG. 4(II), the engine speed increases continuously and the engine speed limit at which the fuel supply is to be cut off is set lower than that in the conventional system. Consequently, the fuel cutoff region can be extended.

FIG. 4(III) shows the variation of engine speed with respect to time when the gear position of the transmission 2 is changed downwards from third gear to second gear. As shown in FIG. 4(III), the invention again extends the total fuel cut-off time beyond that achieved with equal safety in the conventional system.

As appreciated from FIGS. 4(I) through 4(III), the present invention can inhibit the cutoff of fuel supply for such a short time period (e.g., one second or less) and can extend the total fuel supply cutoff time in extended fuel cut-off situations.

It should be noted that $N_R+\Delta N$ can be used in place of $N_R$ shown in FIG. 3 to determine the start of fuel cutoff, wherein $\Delta N$ is an arbitrary positive number, so that to prevent inadvertent engine stalling due to deviations in engine characteristics imparted during engine manufacture.

According to the present invention, since the engine speed at which the fuel supply is to be cut off is estimated on the basis of torque before the fuel supply is cut off and the question of whether or not to interrupt the fuel supply is decided on the basis of the estimated engine speed, the fuel cutoff resulting in limitted fuel conservation, possible emission of harmful exhaust components, and vehicle shock can be prevented.

It will be clearly appreciated by those skilled in the art that the foregoing description is made in terms of the preferred embodiment and various changes and modifications may be made without departing from the scope of the present invention, which is to be defined by the appended claims.

What is claimed is:

1. A system for supplying fuel to a vehicular internal combustion engine, comprising:
   (a) first means for detecting a speed of the vehicle from an instantaneous revolutin speed of an output axle of a transmission of the vehicle;
   (b) second means for detecting a gear shift position of the transmission;
   (c) third means for determining a first engine speed at which the supply of fuel to the engine is to be cut off on the basis of the instantaneous revolution speed of the output axle of the transmission detected by said first means and the gear shift position of the transmission;
   (d) fourth means for comparing the first engine speed to a preset second engine speed at which the supply of fuel is to be resumed following the cut-off of the supply of fuel to the engine; and
   (e) fifth means for cutting off the supply of fuel only when the first engine speed exceeds the preset second engine speed.

2. The system according to claim 1 wherein said third means determines the first engine speed on the basis of an instantaneous revolution speed of an input axle of the transmission which is derived from the following equation:

$$N_{Tin}=R_s \cdot k \cdot V$$

wherein k is a predetermined constant, V is the detected vehicle speed, and $R_s$ is a constant determined by the gear position of the transmission.

3. A system for supplying fuel to a vehicular internal combustion engine, comprising:
   (a) first means for determining whether a throttle valve of the engine is fully closed;
   (b) second means for calculating an engine speed at which the fuel supply to the engine is to be cut off on the basis of a transmission torque to the engine when said first means determines that the throttle valve is fully closed;
   (c) third means for setting an engine speed at which the fuel supply to the engine is to be resumed with deviations in engine characteristics imparted during engine manufacture in mind; and
   (d) fourth means for cutting off the fuel supply when the calculated engine speed exceeds the set engine speed.

4. The system according to claim 3, wherein said second means calculates the engine speed on the basis of the transmission torque derived from a current gear ratio of a power transmission of the vehicle and vehicular speed.

5. A method for supplying fuel to a vehicular internal combustion engine, comprising the steps of:
   (a) determining whether a throttle valve of the engine is fully closed;
   (b) detecting an instananeous revolution speed of an output axle of an automatic transmission when the throttle valve is fully closed;
   (c) detecting a gear shift position of the automatic transmission;
   (d) calculating the revolution speed of an input axle of an automatic transmission on the basis of the output axle of the automatic transmission and the gear shift position when the throttle is fully closed;
   (e) deriving an engine speed at which the fuel supply to the engine is to be cut off from the revolution speed of the input axle of the automatic transmission calculated in the step (d);
   (f) comparing the engine speed derived in the step (e) to a preset engine speed at which the fuel supply is to be resumed following cut-off; and
   (g) cutting off the fuel supply only when the derived engine speed exceeds the preset engine speed in the step (f).

* * * * *